United States Patent [19]

Watkinson

[11] Patent Number: 4,722,269

[45] Date of Patent: Feb. 2, 1988

[54] PORTABLE CAN CRUSHER

[76] Inventor: John W. Watkinson, 41 Maple Road North, Shelthorpe, Loughborough, Leicestershire, England

[21] Appl. No.: 925,913

[22] Filed: Nov. 3, 1986

[51] Int. Cl.[4] ..... B30B 3/02; B30B 9/32

[52] U.S. Cl. ..... 100/156; 100/902; 100/100; 100/153; 100/210

[58] Field of Search ..... 100/902, 156, 100, 210, 100/153

[56] References Cited

U.S. PATENT DOCUMENTS

| | | | |
|---|---|---|---|
| 3,776,128 | 12/1973 | Morris | 100/902 X |
| 4,057,010 | 11/1977 | Smith | 100/100 X |
| 4,261,259 | 4/1981 | Bearzdslee | 100/902 |
| 4,358,995 | 11/1982 | Ballo et al. | 100/100 |
| 4,417,512 | 11/1983 | Engelke | 100/902 X |
| 4,516,489 | 5/1985 | Ballo | 100/902 |

FOREIGN PATENT DOCUMENTS

| | | | |
|---|---|---|---|
| 60-102298 | 6/1985 | Japan | 100/902 |

*Primary Examiner*—Andrew M. Falik

*Attorney, Agent, or Firm*—Charles E. Brown; Charles A. Brown

[57] ABSTRACT

A portable can crusher for reprocessing cans such as beer cans and the like. The crusher includes a hopper in which a baffle (16) is provided for directing cans towards an elongate aperture (19) formed between a casing base and a driven reprocessing wheel (20). The wheel (20) has deformation means (24) on its periphery not only to compress cans fed to the aperture (19) but also to assist in the feeding of cans through the aperture. The can crusher may be trailer or vehicle mounted.

5 Claims, 3 Drawing Figures

PORTABLE CAN CRUSHER

The present invention relates to an apparatus for reprocessing metal cans and in particular to a can crusher.

After crowds have gathered for football matches and the like a large number of empty disposable cans which originally contained soft or alcoholic drink remain to be cleared. At the present time the empty cans are loaded into a container such as a skip prior to removal for dumping as scrap. Since the empty cans occupy the same volume as full ones, it can be necessary to take away several skips of empty cans which is necessarily time consuming and expensive.

Generally, the empty cans are scrapped rather than reprocessed and even when further treatment does occur it does so in a plant remote from the loction of the fooball match or the like.

In accordance with the broadest aspect of the present invention there is provided a portable can crusher for reprocessing metal cans by crushing them into a compacted form ready for storage.

The portable can crusher of the invention comprises a hopper into which cans to be reprocessed are received, a baffle in the hopper directing the cans under the influence of gravity towards an elongate aperture formed between the hopper base and a driven reprocessing wheel having can deformation on the periphery thereof, in use, to compress cans fed to the elongate aperture so that compressed cans emerge from the other side of the elongated aperture.

The upper part of the hopper may contain secondary baffles for presenting a stream of cans to be compressed in a continuous manner to the elongate aperture.

The can deformation means may consist of at least one land welded or otherwise secured to the wheel. Alternatively or additionally, flails may be secured to the driven wheel to form at least part of the deformation means.

The wheel is preferably belt-driven either from an internal combustion engine or an electric motor.

The portable can crusher is conveniently bolted onto a trailer or a self-propelled vehicle.

A receptacle such as a skip, may be placed at an outlet chute from the crusher to collect compressed cans ready for removal.

The invention will now be described further by way of example with reference to the accompanying drawings in which.

Figure 1:
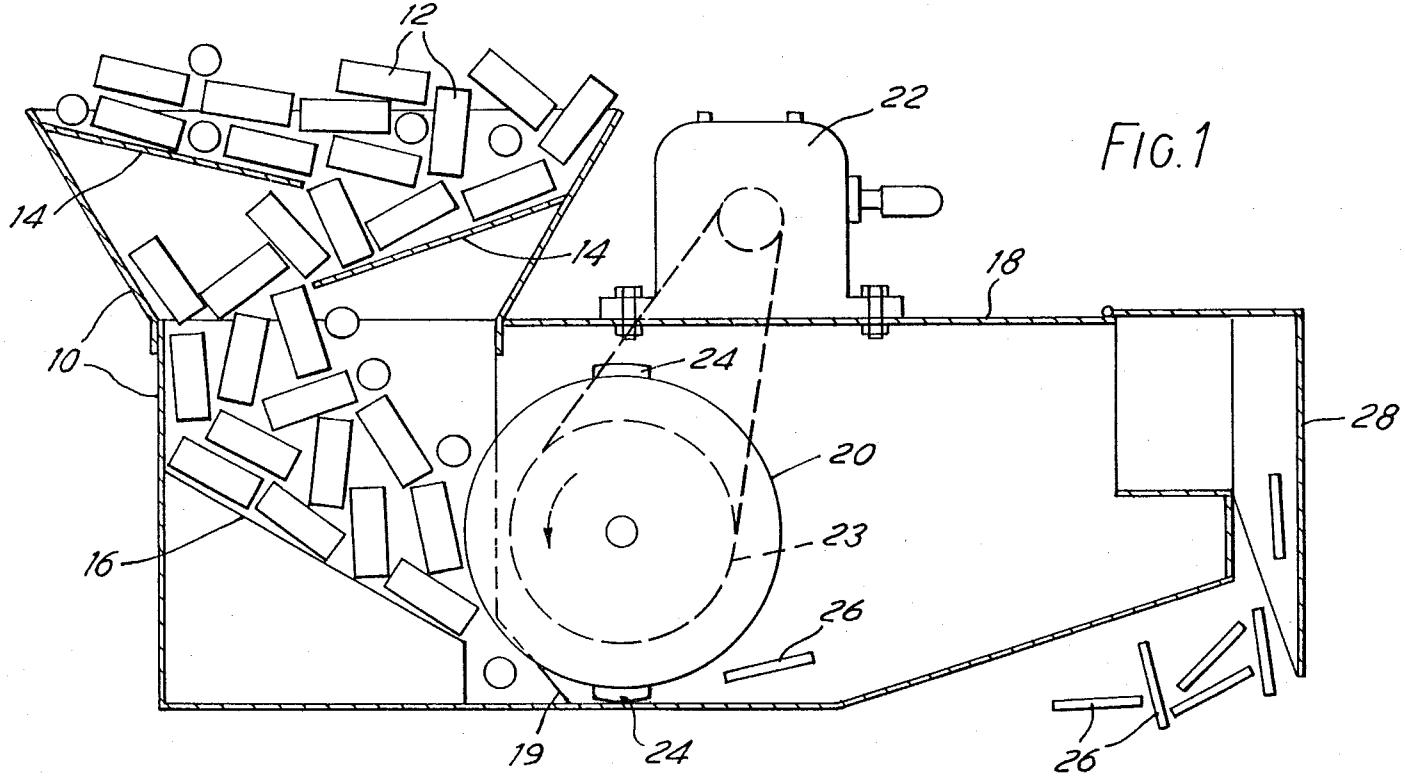
FIG. 1 is a broken away diagrammatic, side elevational view of a can crusher in accordance with a preferred embodiment of the invention.
Figure 2:
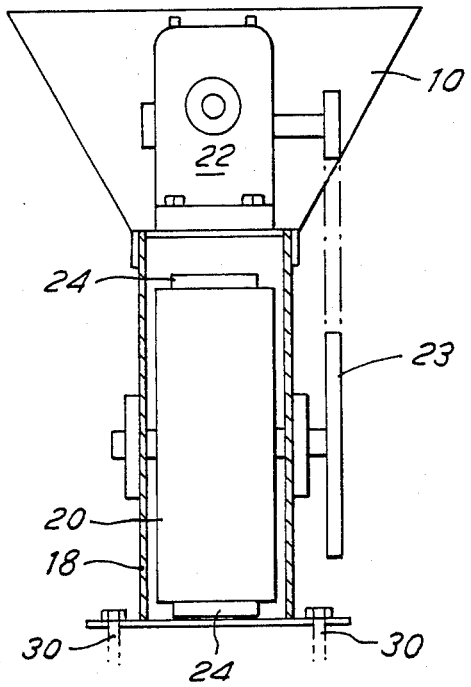
FIG. 2 is a partly broken away end elevation of the can crusher shown in FIG. 1.
Figure 3:
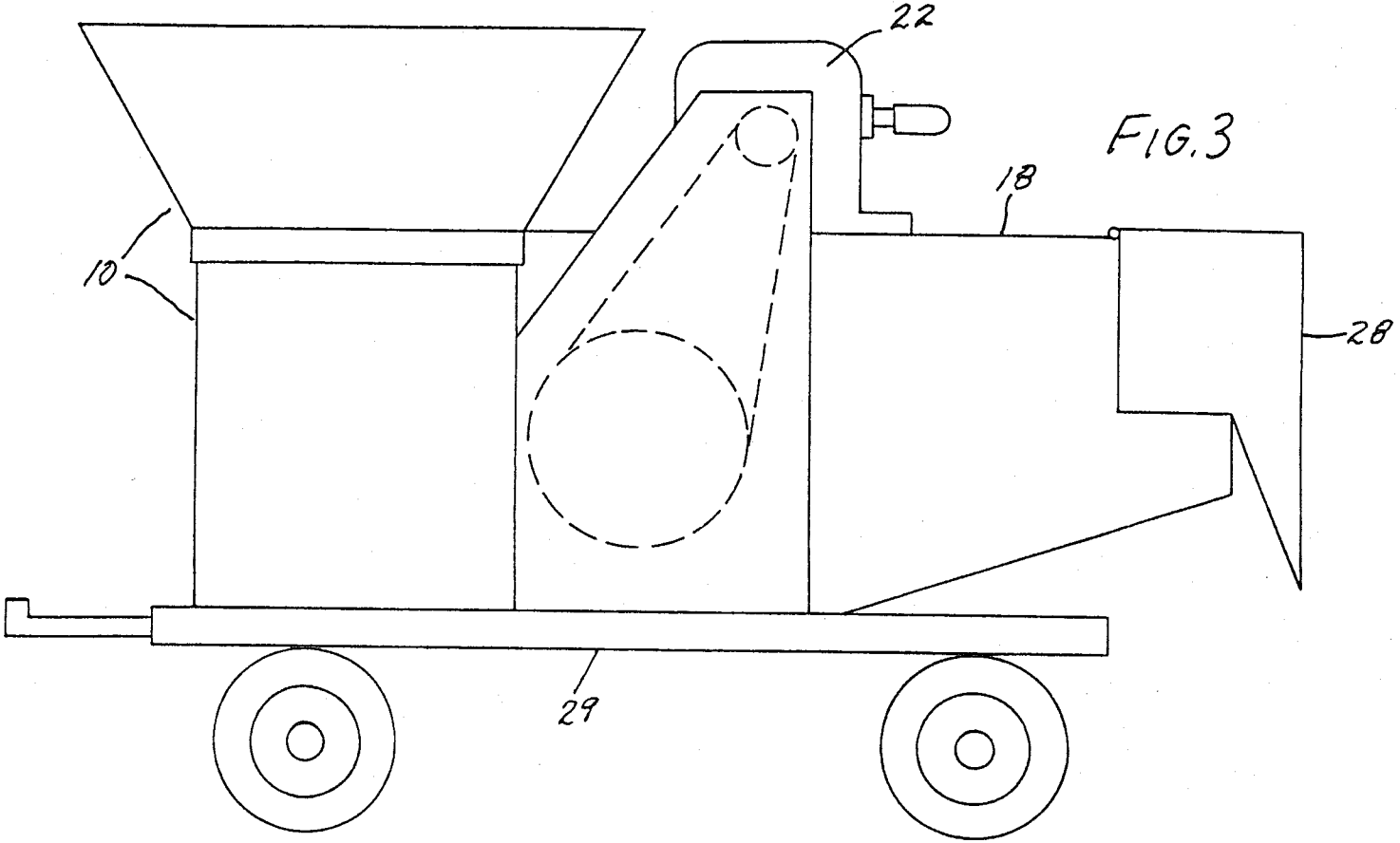
FIG. 3 is a side elevational view of the can crusher mounted on a trailer.

The can crusher illustrated consists of a hopper 10 which receives empty metal cans 12 for crushing. Two secondary baffles 14 each of which extends across part of the width of the hopper orient the cans into a stream-like array to pass along a primary baffle 16 in that manner.

The base of the hopper extends into a casing 18 which contains a wheel 20 belt-driven from a petrol driven engine 22 mounted externally of the casing via a pulley 23. The wheel rotates in the direction of the arrow. Two mild steel lands 24 are welded to diametrically opposite sides of wheel. In the top-dead-center position illustrated the clearance between the bottom land 24 and the casing 18 is 2 mm.

In use, empty cans 12 are loaded into the hopper 10, as illustrated, and arranged in a stream-like array by the baffles 14. When the cans arrive at the baffle 16 they are fed, to the right, as viewed, towards the elongated aperture 19 between the wheel and the casing. The lands 24 assist in drawing the cans towards the aperture where a subsequent land 24 drives the cans through the 2 mm deep aperture and in so doing compresses them into the flattened form indicated at 26.

The flattened cans 26 are projected towards the rear of the casing when they are removed via a chute 28.

The can crusher is mounted upon a trailer 29 or other movable device such as a sledge by bolts 30. Hence, when a stadium for example is to be cleared, the portable can crusher is brought into a convenient position and set into operation. Since the cans are removed in reduced volume condition many more cans can be fitted into a skip for removal purposes than was possible hitherto.

It has been found that the wheel may be rotated at speeds of between 60 r.p.m. to 2000 r.p.m., can bulk reduction being about 75% irrespective of the speed of rotation.

If desired, aluminimum cans can be isolated from tin-coated cans by passing the crushed cans beneath a magnet (not shown). It is envisaged that because the cans are in compressed form they may more readily be reprocessed than formerly so that there will be less tendency to scrap them altogether.

I claim:

1. A portable can crusher comprising a hopper into which cans to be reprocessed are received said hopper extending into a casing the bottom of which defines a base, baffle means in the casing directing cans under the influence of gravity towards the hopper base, a driven reprocessing wheel mounted in spaced relationship from the casing base so as to from an elongated aperture between said wheel and casing base, the axis of rotation of said wheel lying transversely to the flow of cans directed over the baffle means, at least one land welded or otherwise secured to the periphery of said wheel, the spacing between said at least one land and the casing base when said land is in a lowermost position being approximately 2 mm, wherein cans fed toward one side of said elongate aperture are compressed as they emerge from the other side of said elongate aperture.

2. A can crusher as set forth in claim 1 wherein said wheel is operated at a speed lying in the range 60 r.p.m. to 2000 r.p.m.

3. A can crusher as set forth in claim 1 wherein a plurality of secondary baffles are provided for presenting a stream of cans to be compressed in a continuous manner towards said baffle means.

4. A can crusher as set forth in claim 1 wherein the can crusher is mounted on a trailer.

5. A can crusher as set forth in claim 1 wherein an outlet chute is provided in the casing to enable compressed cans to be removed therefrom.

* * * * *